US007401433B2

(12) United States Patent
Schiller et al.

(10) Patent No.: US 7,401,433 B2
(45) Date of Patent: Jul. 22, 2008

(54) TELESCOPIC SIGHT HAVING AN ILLUMINATION APPARATUS

(75) Inventors: Juergen Schiller, Wetzlar (DE); Volker Claudi, Lahnau (DE); Thomas Wagner, Wettenberg (DE); Reiner Geller, Wetzlar (DE)

(73) Assignees: Carl Zeiss Sports Optics GmbH, Wetzlar (DE); Carl Zeiss Optronics GmbH, Wetzlar (DE)

( * ) Notice: Subject to any disclaimer, the term of this patent is extended or adjusted under 35 U.S.C. 154(b) by 472 days.

(21) Appl. No.: 11/235,628

(22) Filed: Sep. 26, 2005

(65) Prior Publication Data

US 2007/0245616 A1 Oct. 25, 2007

(30) Foreign Application Priority Data

Sep. 27, 2004 (DE) ..... 10 2004 047 573

(51) Int. Cl.
*F41G 1/38* (2006.01)

(52) U.S. Cl. ..... 42/123; 42/122; 42/132

(58) Field of Classification Search ..... 42/122, 42/123, 132

See application file for complete search history.

(56) References Cited

U.S. PATENT DOCUMENTS 2,476,340 A * 7/1949 Wallhausen ..... 250/467.1
4,822,994 A * 4/1989 Johnson et al. ..... 250/214 VT
5,140,151 A * 8/1992 Weiner et al. ..... 359/210
5,283,427 A * 2/1994 Phillips et al. ..... 250/214 VT
5,434,704 A * 7/1995 Connors et al. ..... 359/403
5,456,035 A * 10/1995 Stiles ..... 42/120
6,721,095 B2 * 4/2004 Huber ..... 359/427
2004/0047586 A1 3/2004 Schick et al.

FOREIGN PATENT DOCUMENTS

DE 202 08 819 U1 11/2002
DE 101 36 278 A1 2/2003

* cited by examiner

*Primary Examiner*—Troy Chambers
(74) *Attorney, Agent, or Firm*—Harness, Dickey & Pierce, P.L.C.

(57) ABSTRACT

An illumination apparatus for a telescopic sight has a lamp, in particular for a reticle of the telescopic sight. The apparatus comprises a control circuit for supplying the lamp, and an adjustment knob cooperating with the control unit for adjusting the brightness of the lamp. Incremental markings are associated with the adjustment knob. The control unit is provided with first means for scanning the incremental markings when the adjustment knob is operated, second means for generating incremental signals, and third means for generating from the incremental signals a signal for controlling the brightness of the lamp.

18 Claims, 3 Drawing Sheets

TELESCOPIC SIGHT HAVING AN ILLUMINATION APPARATUS

FIELD OF THE INVENTION

The present invention is related to the field of telescopic sights or rifle scopes.

More specifically, the invention is related to the field of telescopic sights having an illuminated reticle.

Still more specifically, the invention is related to an illumination apparatus for a telescopic sight having a lamp, in particular for a reticle of the telescopic sight, comprising a control circuit for supplying the lamp, and an adjustment knob cooperating with the control unit for adjusting the brightness of the lamp.

BACKGROUND OF THE INVENTION

For telescopic sights, in particular for precision long-barrel guns, it is well-known to illuminate the reticle of the telescopic sight by means of a special illumination assembly. In a conventional illuminated reticle, a potentiometer is arranged within a laterally protruding assembly (commonly referred to as "Turm" in the German art) of the sight, the potentiometer being actuated by the user via an externally accessible rotatable knob. The potentiometer is arranged within the circuit of a lamp being supplied from a battery. Instead of using a potentiometer, it is also known to use a rotary switch with a plurality of switching positions to which a resistance cascade is connected.

In this context one has a well-known problem, namely that the battery used for supplying current to the illuminated reticle is discharged too quickly when the illuminated reticle is switched on for a too long period of time or when it remains switched on inadvertently.

German Utility Model document DE 202 08 819 U1 describes a telescopic sight having a reticle illumination unit. The illumination unit comprises a rotary potentiometer, however, it further comprises a push switch, such that the illumination unit may be switched off or on in any rotary position of the potentiometer. By doing so, the rifleperson, for saving battery capacity, may switch the illumination unit off in the last set brightness position, and may switch it on again, if needed, in particular when a target object appears, wherein the same brightness as had been set before is immediately set.

This and other prior art illumination units for telescopic sights, operating with rotary potentiometers or the like, have the disadvantage that the brightness varies as a function of the particular characteristic of the potentiometer, when the rotary knob is rotated. The characteristic is conventionally linear. Therefore, the brightness gradually increases or decreases, respectively, when the rifleperson turns the rotary knob.

This approach does not take into account that the lamp used normally has a non-linear characteristic (radiation intensity vs. current consumption). The same applies for the sensitivity of the eye which, in addition, may substantially vary from rifleperson to rifleperson. All these characteristics are difficult to evaluate beforehand and may in no event be compensated by a standard potentiometer. In practice it is almost or entirely impossible to properly match the brightness adjustment to extreme light conditions.

The same considerations apply for the industrial mass production of such illumination units. The components supplied from the suppliers, namely in particular the lamps and the rotary potentiometers, also vary from one component to another and, in particular, from batch to batch.

One might theoretically consider to avoid the afore-discussed problems at least partially in that rotary switches in conjunction with resistance cascades are used, as already described, wherein the individual resistances within the resistance cascade are selected in accordance with the desired overall characteristic.

Such an approach, however, would require extreme efforts and would involve substantial production costs. Moreover, for technical and spatial reasons the number of resistances for such a resistance cascade would be limited, such that only an illumination adjustment with coarse resolution could be effected.

Moreover, for an exact representation of the characteristic the resistances would have to be individually selected and assembled for each unit.

Finally, prior art illumination units with rotary potentiometers have the disadvantage that the mechanical angle of rotation of the potentiometer is conventionally limited to a value of substantially less than 360°. Limit stops are provided at the two end positions of the rotary potentiometer which not only require certain efforts in production but may also be mechanically damaged under the rough conditions under which firearms are actually used.

It is, therefore, an object underlying the invention, to improve an illumination unit of the type specified at the outset such that these disadvantages are avoided.

In particular, an illumination unit shall be created which allows to be individually matched to existing characteristics by using relatively simple and low-cost means, even under mass production conditions. Furthermore, a limitation in the actuation of the adjustment element, such as limit stops or the like, shall be avoided, such that the brightness may be increased or decreased starting from any position of the adjustment element.

SUMMARY OF THE INVENTION

In an illumination apparatus of the type specified at the outset this object is achieved in that incremental markings are associated with the adjustment knob, and that the control unit is provided with first means for scanning the incremental markings when the adjustment knob is operated, second means for generating incremental signals, and third means for generating from the incremental signals a signal for controlling the brightness of the lamp.

The problem underlying the invention is thus entirely solved.

By sensing the actual position and movement of the adjustment knob via incremental markings, a signal is available in a simple manner that may be digitally processed by electronic means. Therefore, it is easily possible with standard components which are available at low costs to configure certain characteristics allowing an almost ideal compensation of existing characteristics. This holds true for characteristics of the electrical and electronic components of the illumination apparatus as well as for the characteristic of the particular rifleperson's vision.

Incremental marks, moreover, have the advantage that they may be used in almost any conceivable spatial arrangement so that also "endless" arrangements may be used requiring neither mechanical limit stops nor a defined zero position. The range of brightness variation is, thus, transferred somewhere into the path of the incremental markings without a defined geometric zero point existing. One can, therefore, freshly start the adjustment procedure out of any rotary position of the adjustment knob without having the necessity of an electrical or a mechanical limit stop or zero point.

In a preferred embodiment of the inventive illumination apparatus the incremental markings are connected to the adjustment knob.

This measure has the advantage that the incremental markings are a part of a component that is relatively simple to exchange, though it would of course also be possible to arrange the incremental markings on a portion of the illumination apparatus being rigidly connected to the telescope sight, for example the protruding "Turm" assembly.

Another group of embodiments of the invention is characterized in that the adjustment knob is adapted to be rotated about an axis, and that the incremental markings are arranged along a circle centered about the axis.

This measure has the advantage that the inventive concept may be put into practice with conventional rotary knobs as are known and have proven reliable on illumination apparatuses of the type of interest here.

A particularly good effect is achieved in that the first means are configured as mechanical, optical, magnetic or as inductive scanning means.

This measure has the advantage that a relatively solid and simple setup of the first means is achieved in the case of mechanical scanning means, for example, though, of course, instead of mechanical scanning means optical, magnetic or inductive or other known arrangements could likewise be used, which, however, each have a certain electrical power consumption and, in the present context, would constitute another load to the battery.

In this embodiment of the invention it is further preferred when the incremental markings are configured as alternately electrically non-conductive and electrically conductive first areas, respectively, of a surface of a printed circuit board, and that the scanning means comprise at least one first touch contact engaging the first areas.

This measure has the advantage that the incremental markings may be configured in various shapes within a large range, for example depending on which resolution is desired in relation to the angle of rotation or, more generally speaking, to the actuation movement of the adjustment knob. Likewise, also with regard to the configuration of the touch or sliding contacts reliable components are available which may be used as desired.

In another preferred advanced version of this embodiment two first touch contacts are provided, the first areas having the same width in the direction of movement of the first touch contacts when the adjustment knob is operated, and the first touch contacts being arranged at a distance from one another corresponding to an odd multiple of the half width.

This measure has the advantage that the direction of movement of the touch contacts relative to the incremental markings may be easily detected.

In another preferred advanced version of this embodiment the surface of the printed circuit board is provided with second electrical areas adapted to be exposed to reference potentials, and wherein the scanning means comprise second touch contacts engaging the second areas.

This measure has the advantage that the first areas of the surface of the printed circuit board may be specifically supplied with current in order to establish a potential difference over the incremental markings.

In an advanced version of this embodiment in which a second touch contact is adapted to be brought into contact with a second area solely when the adjustment knob is actuated in an axial direction, another advantage results, namely that the illumination apparatus may easily be switched on or off by axially displacing the adjustment knob so as to close a corresponding circuit via the second area and the second touch contact. By doing so, there is created still another advantage, namely that the switching is effected independent from the actuating movement of the adjustment knob, so that the brightness is held at the particularly set brightness value, when the adjustment knob is actuated axially and, hence, the illumination apparatus is switched off for saving battery energy.

In preferred embodiments of the invention the third means comprise a decoder in which the incremental signals are generated as pulses, wherein each pulse of the scanning operation corresponds to an incremental mark of one of the first touch contacts.

This measure, known as such, has the advantage that digitally processable signals may be provided in a simple manner.

In a preferred advanced version of this embodiment the decoder, further, generates a direction signal of the scanning operation by comparing incremental signals of the one first touch contact with the incremental signals of the other first touch contact.

This measure has the already mentioned advantage that the direction of rotation of the adjustment knob may be detected with easy means and may be taken into account in the course of the remaining data processing.

According to an advanced version of this embodiment the third means comprise a characteristic curve stage, the characteristic curve stage counting the pulses forwards or backwards depending on the direction signal and, depending on a predetermined characteristic, converts an actual counter reading into a control signal for the brightness of the lamp.

This measure has the advantage that the counter reading is a signal that is linearly depending on the actuating movement of the adjustment knob and may be processed digitally. By means of a table or list a certain table value may be allotted to a counter reading so as to configure arbitrary characteristics. These tables may be easily loaded or may be inserted into the illumination apparatus as ROM components.

Further, in the context of the invention it is preferred when the characteristic curve stage counts the pulses only to a predetermined maximum value or to a predetermined minimum value.

This measure has the advantage that a built-in limiting function is provided, such that the rifleperson may increase the brightness by e.g. turning the adjustment knob only up to a certain maximum value and that a further turning of the adjustment knob does not result in a further variation of the brightness. At the lower end of the brightness scale the same applies mutatis mutandis.

Further in another elaborate version of the invention it is preferred when the lamp is automatically switched off after a predetermined period of time has lapsed, or when the lamp is switched into a flashing mode when the battery has reached a predetermined low state of charge, and/or when the brightness of the lamp is set by pulse-modulating the supply current of the lamp.

In another preferred embodiment of the invention the lamp is composed by a plurality of single lamp elements.

This measure has the advantage that the lamp remains essentially operative even if one of the lamp elements should fail.

Finally there is another preferred embodiment of the invention, according to which a predetermined control signal for the brightness of the lamp is stored in a non-volatile memory, and is used as an initial value for the third means after an interruption in the current supply has occurred.

This measure has the advantage that e.g. after a battery replacement the lamp shines with a finite value that may either be predetermined as a fixed value or may be set in relation to the last set value.

Further advantages will become apparent from the description and the enclosed drawing.

It goes without saying that the afore-mentioned features and those that will be explained hereinafter may not only be used in the particularly given combination but also in other combinations or alone without leaving the scope of the present invention.

BRIEF DESCRIPTION OF THE DRAWINGS

An embodiment of the invention is depicted in the drawing and will be explained in further detail within the subsequent description.

DETAILED DESCRIPTION OF THE PREFERRED EMBODIMENTS

Figure 3:
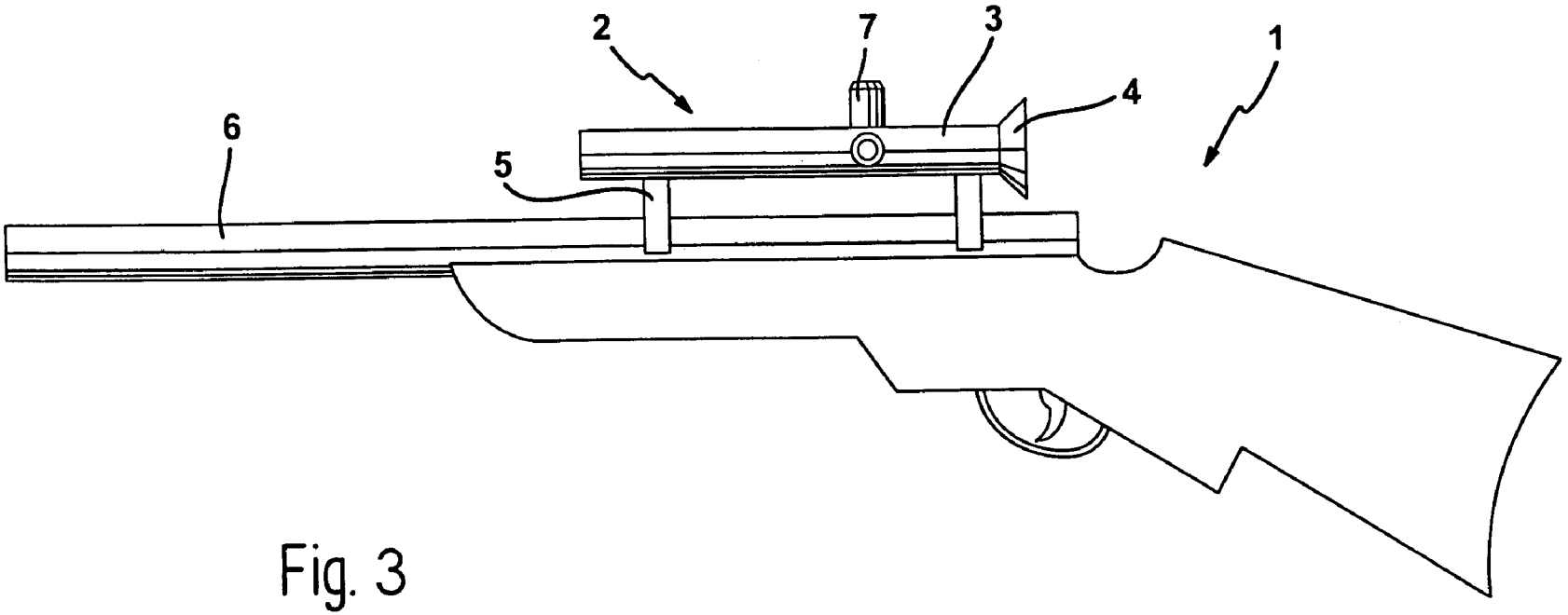
FIG. 3 shows a rifle having a telescopic sight according to the present invention.

Referring initially to FIG. 3, an exemplary rifle 1 having mounted thereon a telescopic sight 2 according to the present invention is shown. The telescopic sight 2 is mounted to the barrel 6 of the rifle 1 via a mounting fixture 5 in a conventional manner. The telescopic sight 2 comprises a cylindrical barrel 3 having an eyepiece 4 located at the rearward end of the barrel 3. Located atop the barrel 3 is a protruding assembly 7 which houses the illumination apparatus 10 according to the present invention.

Figure 1:
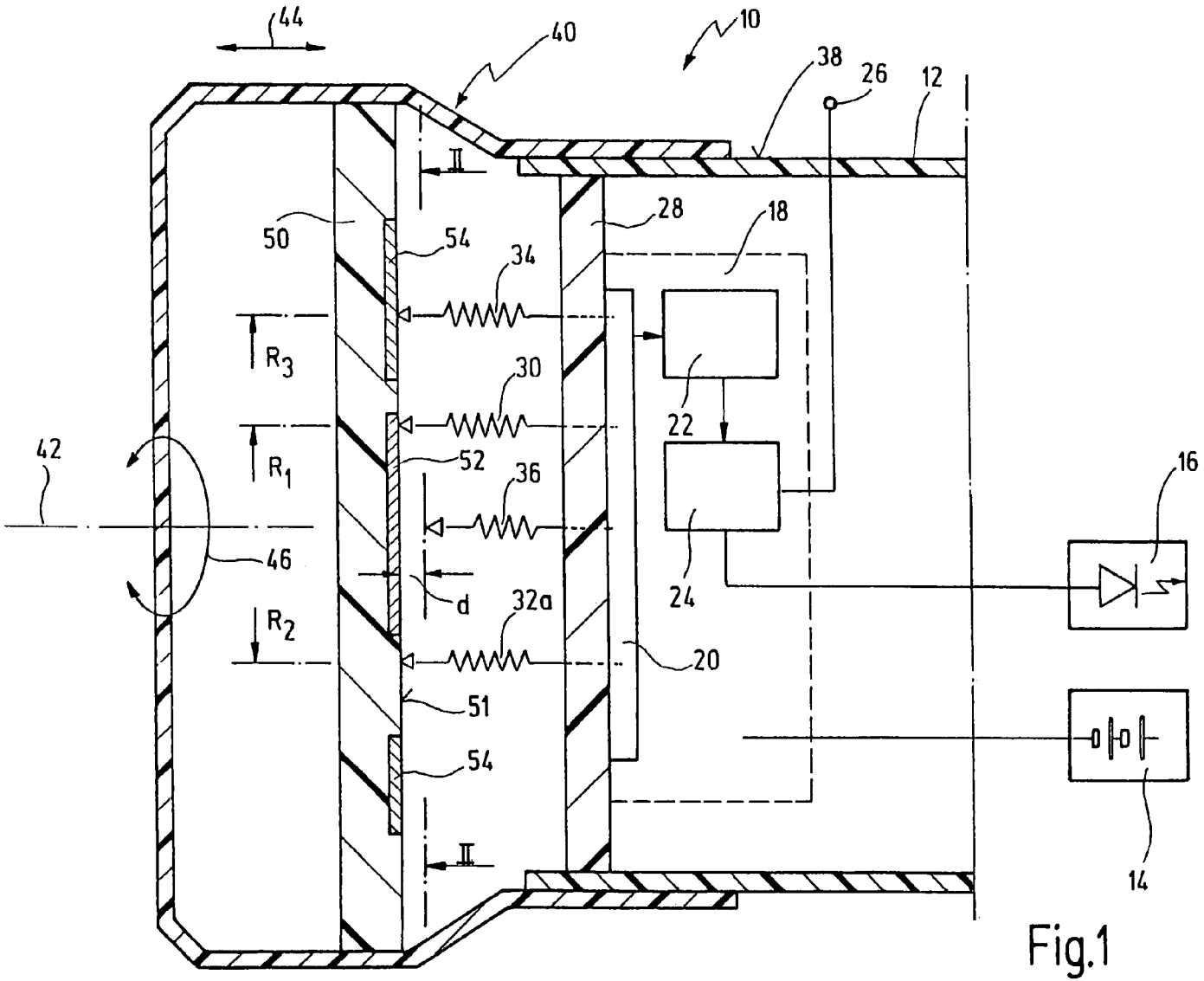
FIG. 1 shows a side elevational, cross-sectional view of an embodiment of an inventive illumination apparatus.

In FIG. 1 reference numeral 10 as a whole designates an embodiment of an illumination apparatus for a telescopic sight, in particular for an illuminated reticle, according to the present invention.

Within a flange 12 of a protruding assembly of a telescopic sight (commonly referred to as "Turm" in the German art), there is located a battery 14 as well as a lamp 16 which is current-supplied from battery 14. Lamp 16, preferably, is a light emitting diode. However, lamp 16 may also consist of a plurality of individual lamp elements.

The supply of lamp 16 from battery 14 is affected via an electronic control unit 18. Electronic control unit 18 comprises a signal sensing unit 20, a decoder 22 as well as a characteristic curve stage 24, the output of which being connected to lamp 16. Further, characteristic curve stage 24 is accessible via an external input 26. The operation of electronic control circuit 18 will be explained further below.

Electronic control unit 18 is located on the rear side of a first printed circuit board 28 being rigidly housed in flange 12. A first touch contact 30, two second touch contacts 32*a*, 32*b*, a third touch contact 34 as well as a fourth touch contact 36 are all located on a front side of printed circuit board 28. Fourth touch contact 36 has a somewhat shorter axial length as compared to touch contacts 30, 32*a*, 32*b* and 34, as shown in FIG. 1 at d. The term "touch contact" is to be understood to mean any sensing or scanning device capable of detecting a marking, i.e. any mechanical, optical, magnetic, inductive, capacitive or other device that may be used for that purpose.

An adjustment knob, identified as a whole with reference numeral 40 is pushed onto an outer periphery 38 of flange 12. Adjustment knob 40 is adapted to be turned about and to be axially shifted along a common axis 42 as shown by double arrows 44 and 46.

A second printed circuit board 50 is rigidly held within adjustment knob 40. Second printed circuit board 50 extends essentially parallel to first printed circuit board 28 and faces the latter at a distance, such that first touch contact 30, second touch contacts 32*a*, 32*b* as well as third touch contact 34 elastically come to rest against a surface 51 of second printed circuit board 50 facing first printed circuit board 28. Only fourth touch contact 36 is at the operational position of adjustment knob 40 shown, i.e. at a distance d from surface 51.

Figure 2:
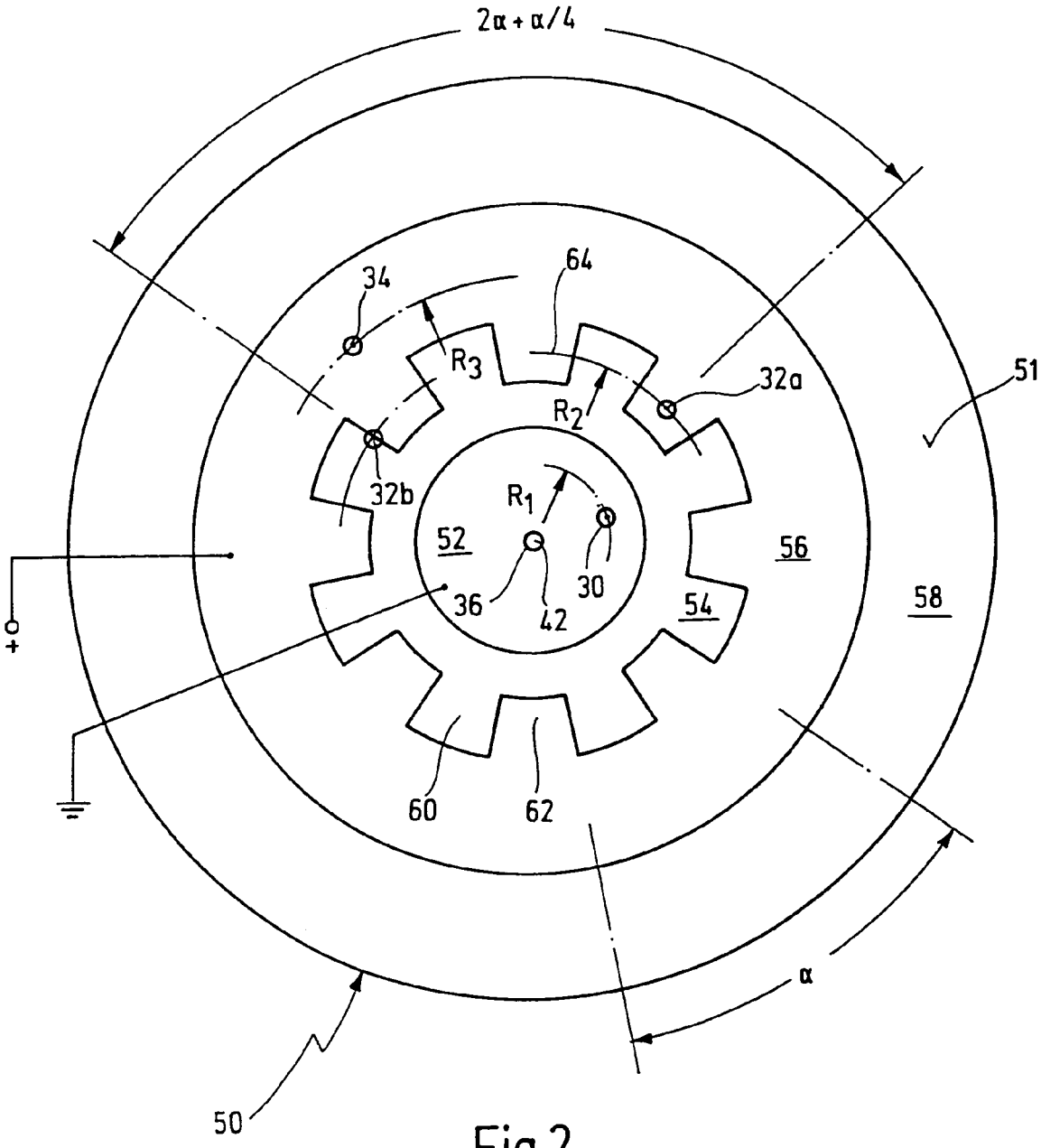
FIG. 2 shows a top plan view along line II-II on a printed circuit board, as is comprised within the illumination apparatus of FIG. 1.

As one can see particularly well in the top plan view of FIG. 2, second printed circuit board 50 is subdivided into several areas on surface 51. In the center, i.e. in the area of axis 42, there is a first, electrically conductive area 52 being encircled by a first electrically non-conductive area 54 which, in turn, is encircled by a second electrically conductive area 56 and, finally at the periphery thereof a second electrically non-conductive area 58.

As can clearly be seen from FIG. 2, areas 54 and 56 mesh with each other like toothed wheels, such that in the embodiment shown eight electrically non-conductive incremental areas 60 alternate along a circle 64 with eight electrically conductive incremental areas 62.

FIG. 2, further, shows that first touch contact 30 is located at a distance $R_1$ from the center, i.e. from axis 42. Upon turning of adjustment knob 40 the contact tip of first touch contact, therefore, runs along a circular path of radius $R_1$.

Second touch contacts 32*a*, 32*b* correspondingly run along circular paths with a radius $R_2$. They are distant from each other along this circular path by an arcuate length $2\alpha+\alpha/4$, wherein $\alpha$ is the entire arcuate length of a non conductive plus a conductive incremental area 60, 62.

Third touch contact 34 is located at a distance $R_3$ from axis 42, such that upon turning of adjustment knob 40 it runs along a circular path of radius $R_3$.

Fourth touch contact 36, finally, is located along axis 42.

In the embodiment shown first electrically conductive area 52 is grounded, and second electrically conductive area 56 is connected to a positive reference potential.

This means that first touch contact 30 is grounded at all times because it always runs along a circular path with radius $R_1$ which fully lies within first electrically conductive area 52. In contrast, third touch contact 34 is connected to the positive reference potential because the circular path with radius $R_3$ fully lies within second electrically conductive area 56.

Second touch contacts 32*a*, 32*b*, however, come to lie in an alternating manner on second electrically conductive area 56, i.e. on the positive reference potential, and on first electrically non-conductive area 54, respectively.

This means that second touch contacts 32*a*, 32*b* are in an alternating manner connected to the positive electrical reference potential and to no potential.

The voltage pulses thus generated on second touch contacts 32*a*, 32*b* are fed to decoder 22 via signal sensing unit 20, for example an amplifier and a pulse-shaping stage. Decoder 22, for example, comprises an up/down counter. The count or reading of the counter corresponds to the amount of turning of adjustment knob 40, wherein a turning of adjustment knob 40 in the one direction causes a count upward and a turning in the opposite direction causes a count downward. The counter, preferably, is configured such that it counts only to a maximum value, so that a limitation is provided insofar. If, therefore, the rifleperson turns adjustment knob 40 beyond this threshold value of the counter, this means that the counter reading is not further increased or decreased, respectively.

The prevailing reading of the counter is fed to characteristic curve stage 24. Characteristic curve stage 24, for example, comprises an electronically memorized table for allotting to each counter reading a particular level which, in turn, causes a predetermined radiation intensity, i.e. brightness of lamp 16.

The table or list may be comprised within characteristic curve stage 24 as a fixedly programmed memory element (ROM). As an alternative, however, one might also use a programmable memory element (PROM) which may be programmed via external input 26, for example depending on the personal eye sensitivity characteristic of the particular rifleperson. The table may be likewise re-programmed if, for example, lamp 16 must be replaced and the new lamp has another characteristic as compared to the old lamp.

If adjustment button 40 is shifted from the position shown in FIG. 1 to the right hand side along the direction of axis 42, fourth touch contact 36 will eventually come into contact with first electrically conductive area 52 which, preferably, is grounded. This making of a contact may, for example, be used for switching off electronic control unit 18 as a whole or for transferring same into a sleep mode.

Electronic control unit 18 may be again switched on or waked up by again making a contact between fourth touch contact 36 and first electrically conductive area 52. As an alternative, a minor turning of adjustment knob 40 might likewise be used for triggering a switching-on process.

It is important to note that—in contrast to a conventional potentiometer—adjustment knob 40 may be turned arbitrarily as long as electronic control unit 18 is switched off, without any effect on the brightness of lamp 16 when electronic control unit 18 is switched on again. This is because no counting pulses are generated during the switched-off condition and the counter reading of characteristic curve stage 24 remains unaltered. After switching on again the "endless" incremental marking arrangement freshly starts from the arbitrary rotary position of adjustment knob 40 prevailing at that moment in time.

In order to take care of a situation where the current supply of electronic units, in particular of the third means, i.e. of decoder 22 and of characteristic curve stage 24, is interrupted, for example during a replacement of battery 14, the invention makes provisions that the brightness of lamp 16 is not set to be zero upon return of the current supply. For that purpose, a predetermined, finite signal value is stored in a non-volatile memory (not shown), and this value is used as the initial brightness value upon return of the current supply. This signal value may be given as a fixed value or may be derived from the signal value that had been set as the last such value prior to the interruption of the current supply. The term "non-volatile" memory is to be understood to mean an element being non-volatile as such, for example a magnetic memory, or it may mean a volatile element being sufficiently buffered by a respective electrical charge source.

In the context of the present invention numerous refinements may be conceived without leaving the scope of the present invention.

The programmability of electronic control unit 18 via input 26 may, for example, be used for programming further additional functions.

A first additional function may consist in switching lamp 18 off automatically after a predetermined period of time has lapsed, in order to save battery energy.

A further additional function may consist in indicating a low charge state of battery 14, for example by making lamp 16 flash.

Finally, the supply of lamp 16 may be configured such that different brightnesses are not set by adjusting the supply current accordingly, but by pulsemodulating the supply current at different on/off-ratios.

The invention claimed is:

1. A telescopic sight having an illumination apparatus with a lamp for a reticle of said telescopic sight, comprising a control circuit for supplying said lamp, and an adjustment knob cooperating with said control unit for adjusting a brightness of said lamp, wherein incremental markings are associated with said adjustment knob, said control unit being provided with first means for scanning said incremental markings when said adjustment knob is operated, second means for generating incremental signals, and third means for generating from said incremental signals a signal for controlling said brightness of said lamp.

2. The telescopic sight of claim 1, wherein said incremental markings are connected to said adjustment knob.

3. The telescopic sight of claim 1, wherein said adjustment knob is adapted to be rotated about an axis, said incremental markings being arranged along a circle centered about said axis.

4. The telescopic sight of claim 1, wherein said first means are configured as mechanical, optical, magnetic, inductive or capacitive scanning means.

5. The telescopic sight of claim 4, wherein said incremental markings are configured as alternately electrically non-conductive and electrically conductive first areas, respectively, of a surface of a printed circuit board, said scanning means comprising at least one first touch contact engaging said first areas.

6. The telescopic sight of claim 5, wherein two first touch contacts are provided, said first areas having the same width in a direction of movement of said first touch contacts when said adjustment knob is operated, and said first touch contacts being arranged at a distance from one another corresponding to an odd multiple of a half of said width ($\alpha/2$).

7. The telescopic sight of claim 5, wherein said surface of said printed circuit board is provided with second electrical areas adapted to be exposed to reference potentials, said scanning means comprising second touch contacts engaging said second areas.

8. The telescopic sight of claim 7, wherein a second touch contact is adapted to be brought into contact with a second area solely when said adjustment knob is actuated in an axial direction.

9. The telescopic sight of claim 1, wherein said third means comprise a decoder in which said incremental signals are generated as pulses, wherein, further, each pulse of a scanning operation corresponds to an incremental mark of one of said first touch contacts.

10. The telescopic sight of claim 9, wherein said decoder, further, generates a direction signal of said scanning operation by comparing incremental signals of said one first touch contact with incremental signals of said other first touch contact.

11. The telescopic sight of claim 10, wherein said third means comprise a characteristic curve stage, said characteristic curve stage counting said pulses forwards or backwards depending on said direction signal and, depending on a predetermined characteristic, converts an actual counter reading into a control signal for said brightness of said lamp.

12. The telescopic sight of claim 11, wherein said characteristic curve stage counts said pulses only to a predetermined maximum value or to a predetermined minimum value.

13. The telescopic sight of claim 1, wherein said lamp is automatically switched off after a predetermined period of time has lapsed.

14. The telescopic sight of claim 1, wherein said lamp is switched into a flashing mode when a battery for supplying current to said lamp has reached a predetermined low state of charge.

15. The telescopic sight of claim 1, wherein said brightness of said lamp is set by pulse-modulating a supply current of said lamp.

16. The telescopic sight of claim 1, wherein said lamp is composed by a plurality of single lamp elements.

17. The telescopic sight of claim 1, wherein a predetermined control signal for said brightness of said lamp is stored in a non-volatile memory, and is used as an initial value for said third means after an interruption in said current supply has occurred.

18. An illumination apparatus for a telescopic sight having a lamp for a reticle of said telescopic sight, comprising a control circuit for supplying said lamp, and an adjustment knob cooperating with said control unit for adjusting a brightness of said lamp, wherein incremental markings are associated with said adjustment knob, said control unit being provided with first means for scanning said incremental markings when said adjustment knob is operated, second means for generating incremental signals, and third means for generating from said incremental signals a signal for controlling said brightness of said lamp.

* * * * *